United States Patent [19]

Freitas

[11] Patent Number: 4,928,760

[45] Date of Patent: May 29, 1990

[54] DOWNHOLE COUPON HOLDER

[75] Inventor: Elizabeth A. Freitas, Rangely, Colo.

[73] Assignee: Chevron Research Company, San Francisco, Calif.

[21] Appl. No.: 261,452

[22] Filed: Oct. 24, 1988

[51] Int. Cl.[5] ..... E21B 41/02; E21B 49/08

[52] U.S. Cl. ..... 166/113; 166/902; 73/86; 73/151; 73/853

[58] Field of Search ..... 166/113, 902, 117.5, 166/250, 244.1; 73/86, 151, 852, 853

[56] References Cited

U.S. PATENT DOCUMENTS

| | | | |
|---|---|---|---|
| 2,994,778 | 8/1961 | Marsh | 73/86 |
| 4,002,059 | 1/1977 | Jeffers et al. | 73/86 |
| 4,483,397 | 11/1984 | Gray | 166/117.5 |
| 4,501,323 | 2/1985 | Lively et al. | 166/902 |
| 4,603,113 | 7/1986 | Bauer | 166/902 |
| 4,605,065 | 8/1986 | Abercrombie | 73/86 |
| 4,688,638 | 8/1987 | Williams | 166/902 |

*Primary Examiner*—Bruce M. Kisliuk

*Attorney, Agent, or Firm*—Ernest A. Schaal; Edward J. Keeling

[57] ABSTRACT

An economical, corrosion-resistant, wireline set and retrievable, downhole coupon holder is disclosed that has a non-metallic, elongated member having recessed slots and a mounting means for mounting the coupons within the recessed slots. Preferably, there are six pairs of slots, with each pair of slots being on opposite sides of the elongated member. Each pair of slots shares a common mounting means that fixes the ends of coupons within that pair of slots.

11 Claims, 3 Drawing Sheets

DOWNHOLE COUPON HOLDER

The present invention relates to an economical, corrosion-resistant, wireline set and retrievable, downhole coupon holder that allows for multiple coupon placement for simultaneous corrosion testing of coupons within a wellbore.

BACKGROUND OF THE INVENTION

Corrosion coupons are small representative pieces of metal which are used to evaluate such things as system corrosivity, material performance, and corrosion inhibitor effectiveness. In order to be useful, a corrosion coupon must be placed in a representative location within the system to be monitored. This location must be representative in temperature, pressure, water chemistry, chemical additions, bacterial populations, and solids loading. The coupon must not cause turbulence in the flow stream, otherwise the coupon may corrode faster because of the erosional effects than the system to be monitored. Also, the coupon must be electrically isolated from the holder and from the system to be monitored, otherwise the coupon may corrode faster because of galvanic effects than the system to be monitored.

SUMMARY OF THE INVENTION

The present invention is an apparatus for holding coupons for corrosion testing within a wellbore. That apparatus has a non-metallic, elongated member having recessed slots and a mounting means for mounting the coupons within those recessed slots.

In one embodiment, there is an even number of recessed slots and that number is at least twelve. In that embodiment, the slots form pairs, with each pair of slots being on opposite sides of the elongated member, and each pair of slots sharing a common mounting means that fixes the ends of the coupons within that pair of slots.

That common mounting means can be metallic bolts and nuts. For galvanic testing of the coupons, those metallic bolts and nuts form electrical connections for the coupons. Otherwise, the bolts and nuts are insulated from the coupons so as to prevent electrical grounding of the coupons.

The recessed slots may contain a means for creating stress within the coupons. One such means for creating stress comprises screws coated with non-metallic material.

The apparatus preferably has an attaching means attached to the elongated member for attaching that elongated member to running equipment so that the apparatus can be wireline set and retrievable. That attaching means can be a top sub having both a fishing neck and integral wrench flats.

BRIEF DESCRIPTION OF THE DRAWINGS

In order to facilitate the understanding of this invention, reference will now be made to the appended drawings of the preferred embodiments of the present invention. The drawings a only, and should not be construed as limiting the invention.

DETAILED DESCRIPTION OF THE PREFERRED EMBODIMENTS

Figure 1:
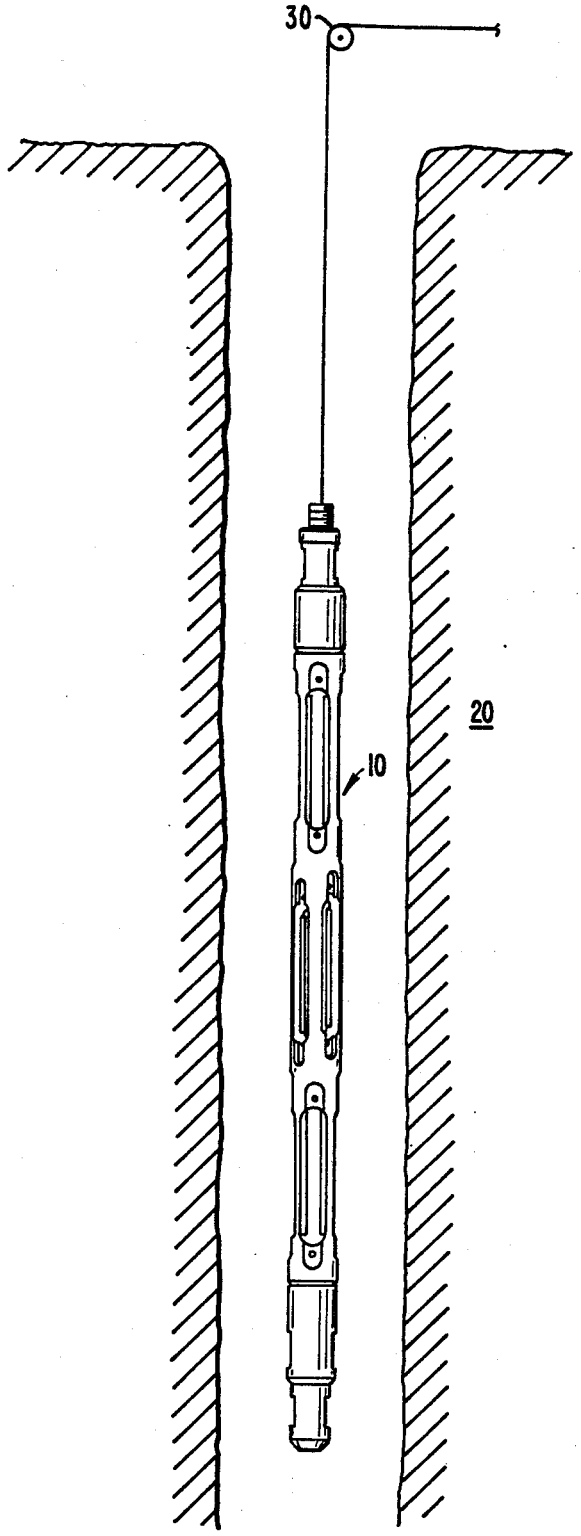
FIG. 1 is a schematic drawing of how the present invention would be used within a wellbore.

In the past, attempts have been made to monitor the corrosivity of a water and carbon dioxide injection system by placing coupons at the wellhead of the injection wells. Sometimes, those coupons have failed to indicate severe corrosion problems because the surface placement of those coupons was not representative of the system. For that reason, the downhole coupon holder of the present invention was designed.

In designing that downhole coupon holder, the following design considerations were used:

1. The holder had to be able to withstand the severe environmental conditions of the injection wells (e.g. 160° F., 25,000 ppm chloride; carbon dioxide injection; 5,000 psi downhole injection pressures: and 20 to 60 ppm dissolved hydrogen sulfide).
2. The holder had to be wireline set and retrievable, having the flexibility of being set anywhere in the selective injection assembly downhole so that both static and flowing conditions could be tested.
3. The holder and assembly had to be less that 111/16 inch in diameter to allow placement in a 2⅜ inch injection string, and the holder and assembly had to have a manageable length (less than six feet).
4. The holder had to be reusable with the coupon attachment/removal easily done in the field.
5. The holder had to have spaces for multiple coupon placement in order to evaluate concurrently a variety of coupons.
6. The holder had to be able to accommodate galvanic testing and stress corrosion cracking testing of coupon materials.

In its broadest aspect, the present invention, that achieves all of these conditions, is an apparatus that comprises a non-metallic, elongated member having recessed slots and a mounting means for mounting the coupons within those recessed slots.

Preferably there are an even number of recessed slots, and preferably there are at least twelve slots. In one embodiment, the elongated member has pairs of recessed slots, with each pair of slots being on opposite sides of the elongated member. These pairs of slots share a common mounting means, such as metallic bolts and nuts, that fixes the ends of the coupons within the slots.

One advantage of the downhole coupon holder of the present invention is that the coupons can be tested for galvanic effects by electrically connecting a pair of coupons. A pair of uninsulated metallic bolts and nuts can be used as the mounting means to form electrical connections for the coupons. If the coupons are not being tested for galvanic effects, then the bolts and nuts should be insulated so as to prevent electrical grounding of the coupons.

The mounting means should be capable of attaching the coupons so that the mounting means is substantially flush with the surface of the elongated member and the coupons are within ⅛ inch of flush with that surface. In that way, we reduce the amount of turbulence that might cause erroneous increases in corrosion.

Another advantage of the downhole coupon holder of the present invention is that the coupons can be tested for stress by having the recessed slots contain a means for creating stress within the coupons. One such means has screws coated with non-metallic material that offset the center of the coupons by a set amount, such as from 1/32 to 3/32 of an inch.

The apparatus can have an attaching means attached to the elongated member for attaching the member to running equipment. One such attaching means is a top sub having both a fishing neck and integral wrench flats.

Referring to FIGS. 1, 2, 3, and 4, which illustrate embodiments of the present invention, FIG. 1 shows apparatus 10 being lowered down wellbore 20 using running equipment 30.

Figure 2:
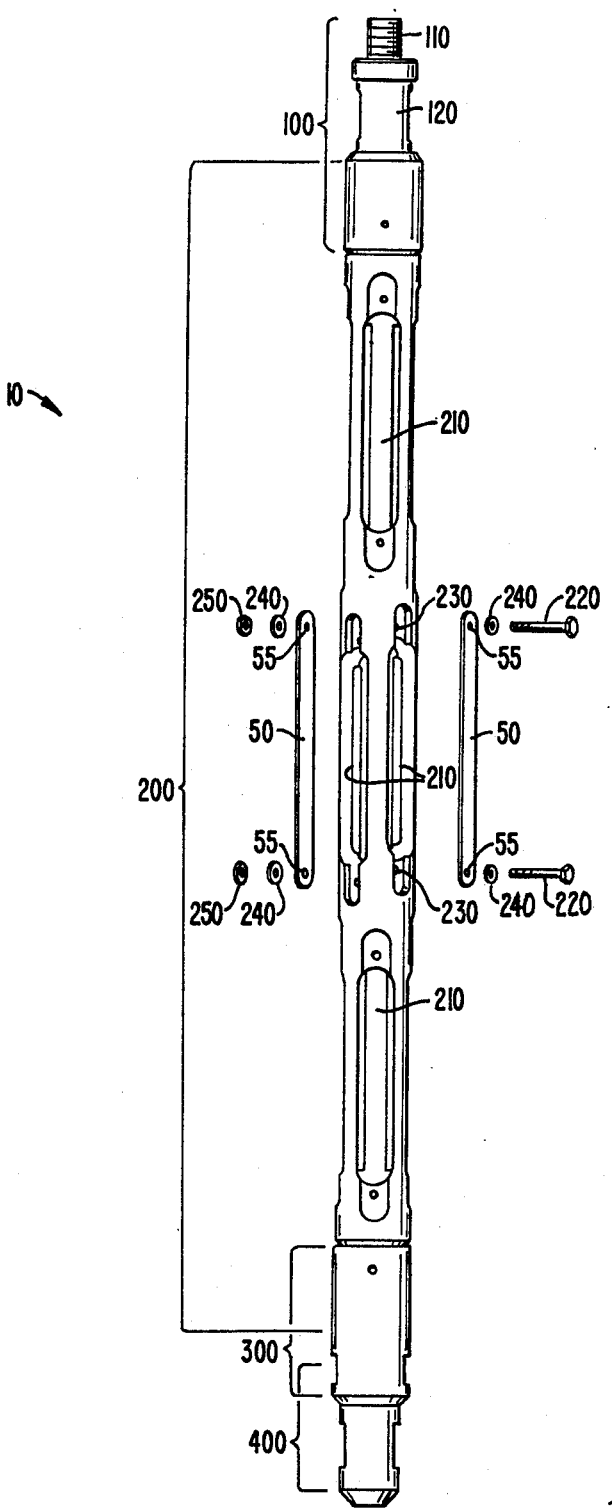
FIG. 2 is a more detailed schematic drawing of one embodiment of the present invention.

FIG. 2 shows a typical coupon 50, having machined holes 55. In FIG. 2, an apparatus 10 is shown for holding coupons within a wellbore comprising a top sub 100, a non-metallic, elongated member 200, a bottom sub 300, and a bull plug 400.

The top sub 100 is an attaching means attached to the non-metallic, elongated member 200 for attaching the elongated member to running equipment. A shock absorber and No Go can be attached between the top sub and the running equipment. The top sub has both a fishing neck 110 and integral wrench flats 120.

The non-metallic, elongated member 200 has recessed slots 210 and a mounting means for mounting the coupons within the recessed slots. That mounting means can consist of bolt 220, hole 230 in the elongated member, and nut 250. The bolt 220 is passed through a first insulating washer 240, passed through a machined hole 55 in a first coupon 50, passed through hole 230 within the elongated member, passed through a machined hole 55 in a second coupon 50, passed through a second insulating washer 240, then is fastened with nut 250. The coupons are mounted within ⅛ inch of flush with the surface of the elongated member.

The threaded ends of the elongated member can alloy any number of other threaded end equipment to be attached, included other non-metallic, elongated members.

Glass reinforce plastic epoxy can be used for the non-metallic, elongated member 200. That material is known by its U.S. government designation G-10. This material is widely used in the manufacture of printed circuit boards. The material was chosen because of its excellent strength, thermal stability, chemical resistance, dielectric strength, and low tendency for water adsorption. The material also is readily available, easily machined, and relatively inexpensive. This material has had excellent performance in all subsequent coupon tests.

The end pieces and all the hardware (i.e., bolts, washers, nuts, etc.) are made of 316 stainless steel. The recessed slots are sized for ½ inch by 6 inch coupons. The coupons are within ⅛ inch of flush when placed in the recesses, which reduces any damage to the coupon when running and pulling the holder.

When the coupons are to be tested for galvanic effects, the insulating washers are not used, and the metallic bolt 220 forms an electrical connection for the coupons within the pair of slots.

Figure 3:
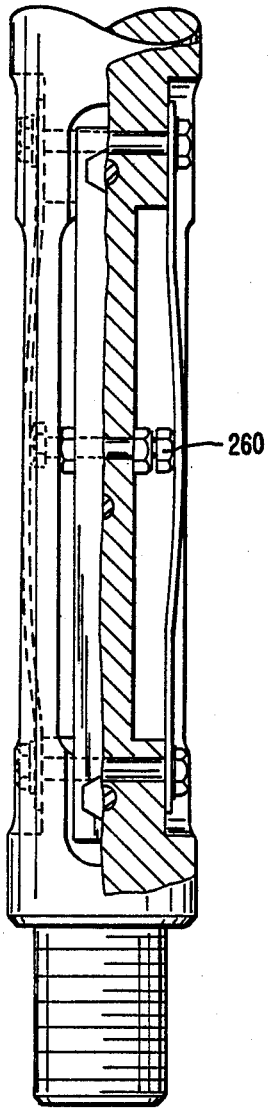
FIG. 3 is a schematic drawing of a portion of the coupon holder, showing how the coupon can be tested for stress.
Figure 4:
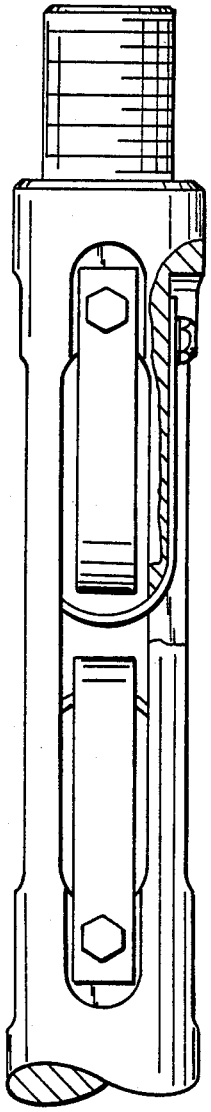
FIG. 4 is a schematic drawing of a portion of the coupon holder, showing an alternative way of how the coupon can be tested for stress.

FIG. 3 and 4 show how the coupon can be tested for stress. In FIG. 3, the means for creating stress within the coupons is screw 260 coated with a non-metallic material. That screw offsets the coupon by from about 1/32 to 3/32 of an inch. In FIG. 4, the means for creating stress within the coupons is a passageway within the elongated member so that the coupon can be bent into a U shape.

Bioprobes can also be attached to the coupons for bacterial studies. One such coupon, designed by Petrolite Chemicals, employs small mild steel buttons known as bioprobes. These bioprobes are of a known surface area enabling a more accurate count of colonies/surface area.

While the present invention has been described with reference to specific embodiments, this application is intended to cover those various changes and substitutions which may be made by those skilled in the art without departing from the spirit and scope of the appended claims.

What is claimed is:

1. An apparatus for holding elongated coupons within a wellbore comprising a non-metallic, elongated member having:

a. longitudinally elongated recessed slots and b. mounting means for mounting said elongated coupons completely within said recessed slots.

2. An apparatus according to claim 1 wherein said elongated member has an even number of recessed slots.

3. An apparatus according to claim 2 wherein said elongated member has at least twelve recessed slots.

4. An apparatus according to claim 2 wherein said elongated member has pairs of recessed slots, with each pair of slots being on opposite sides of said elongated member.

5. An apparatus according to claim 4 wherein said pairs of slots share a common mounting means that fixes the ends of coupons within those pairs of slots.

6. An apparatus according to claim 1 wherein said apparatus further comprises an attaching means attached to said elongated member for attaching said member to running equipment.

7. An apparatus according to claim 6 wherein said attaching means is a top sub having both a fishing neck and integral wrench flats.

8. An apparatus for holding coupons within a wellbore comprising a non-metallic, elongated member having:

a. pairs of recessed slots, with each pair of slots being on opposite sides of said elongated member; and b. mounting means for mounting said coupons within said recessed slots;

wherein said pairs of slots share a common mounting means that fixes the ends of coupons within those pairs of slots, and wherein said common mounting means are metallic bolts and nuts which form electrical connections for coupons within those pairs of slots for galvanic testing of said coupons.

9. An apparatus for holding coupons within a wellbore comprising a non-metallic, elongated member having:

a. pairs of recessed slots, with each pair of slots being on opposite sides of said elongated member; and b. mounting means for mounting said coupons within said recessed slots;

wherein said pairs of slots share a common mounting means that fixes the ends of coupons within those pairs of slots, and wherein said common mounting means are bolts and nuts which are insulated so as to prevent electrical grounding of coupons within those pairs of slots.

10. An apparatus for holding coupons within a wellbore comprising a non-metallic, elongated member having:

a. recessed slots, wherein said recessed slots contains a means for creating stress within said coupons, and b. mounting means for mounting said coupons within said recessed slots.

11. An apparatus according to claim 10 wherein said means for creating stress comprises screws coated with non-metallic material.

* * * * *